US008798998B2

(12) United States Patent
Song et al.

(10) Patent No.: US 8,798,998 B2
(45) Date of Patent: Aug. 5, 2014

(54) PRE-SAVED DATA COMPRESSION FOR TTS CONCATENATION COST

(75) Inventors: Huicheng Song, Beijing (CN); Guoliang Zhang, Beijing (CN); Zhiwei Weng, Beijing (CN)

(73) Assignee: Microsoft Corporation, Redmond, WA (US)

( * ) Notice: Subject to any disclaimer, the term of this patent is extended or adjusted under 35 U.S.C. 154(b) by 955 days.

(21) Appl. No.: 12/754,045

(22) Filed: Apr. 5, 2010

(65) Prior Publication Data

US 2011/0246200 A1 Oct. 6, 2011

(51) Int. Cl.
*G10L 13/00* (2006.01)
*G10L 13/08* (2013.01)

(52) U.S. Cl.
USPC ..... 704/258; 704/260

(58) Field of Classification Search
USPC ..... 704/258, 260
See application file for complete search history.

(56) References Cited

U.S. PATENT DOCUMENTS

| | | | | |
|---|---|---|---|---|
| 4,815,134 | A * | 3/1989 | Picone et al. | 704/222 |
| 5,740,320 | A * | 4/1998 | Itoh | 704/267 |
| 5,983,224 | A * | 11/1999 | Singh et al. | 1/1 |
| 6,009,392 | A | 12/1999 | Kanevsky et al. | |
| 6,173,263 | B1 * | 1/2001 | Conkie | 704/260 |
| 6,366,883 | B1 * | 4/2002 | Campbell et al. | 704/260 |
| 6,684,187 | B1 | 1/2004 | Conkie | |
| 6,829,581 | B2 * | 12/2004 | Meron | 704/258 |
| 6,988,069 | B2 * | 1/2006 | Phillips | 704/258 |
| 7,089,188 | B2 * | 8/2006 | Logan et al. | 704/270 |
| 7,295,970 | B1 | 11/2007 | Gorin et al. | |
| 7,369,994 | B1 | 5/2008 | Beutnagel et al. | |
| 7,389,233 | B1 | 6/2008 | Gish et al. | |
| 7,567,896 | B2 * | 7/2009 | Coorman et al. | 704/10 |
| 7,716,052 | B2 * | 5/2010 | Aaron et al. | 704/258 |
| 2003/0028376 | A1 * | 2/2003 | Meron | 704/258 |
| 2003/0187649 | A1 * | 10/2003 | Logan et al. | 704/260 |
| 2005/0182629 | A1 * | 8/2005 | Coorman et al. | 704/266 |
| 2006/0064287 | A1 * | 3/2006 | Standingford et al. | 703/2 |
| 2006/0287861 | A1 | 12/2006 | Fischer et al. | |
| 2007/0055526 | A1 * | 3/2007 | Eide et al. | 704/260 |
| 2008/0027727 | A1 | 1/2008 | Morita et al. | |
| 2008/0059190 | A1 * | 3/2008 | Chu et al. | 704/258 |

(Continued)

FOREIGN PATENT DOCUMENTS

| | | | |
|---|---|---|---|
| JP | 10049193 | A | 2/1998 |
| KR | 1020060027652 | A | 3/2006 |

OTHER PUBLICATIONS

Sak, et al., "Generation of Synthetic Speech from Turkish Text", Retrieved at <<http://www.cmpe.boun.edu.tr/~hasim/papers/EUSIPCO05.pdf >>, 13th European Signal Processing Conference, 2005, pp. 4.

(Continued)

*Primary Examiner* — Eric Yen
(74) *Attorney, Agent, or Firm* — Steven Spellman; Jim Ross; Micky Minhas

(57) ABSTRACT

Pre-saved concatenation cost data is compressed through speech segment grouping. Speech segments are assigned to a predefined number of groups based on their concatenation cost values with other speech segments. A representative segment is selected for each group. The concatenation cost between two segments in different groups may then be approximated by that between the representative segments of their respective groups, thereby reducing an amount of concatenation cost data to be pre-saved.

18 Claims, 10 Drawing Sheets

(56) References Cited

U.S. PATENT DOCUMENTS

| | | | | |
|---|---|---|---|---|
| 2008/0114800 | A1 * | 5/2008 | Gazen et al. | 707/101 |
| 2009/0083023 | A1 * | 3/2009 | Foster et al. | 704/3 |
| 2009/0132253 | A1 * | 5/2009 | Bellegarda | 704/258 |

OTHER PUBLICATIONS

Bulyko, et al., "Unit Selection for Speech Synthesis UsingSplicing Costs with Weighted Finite State Transducers", Retrieved at <<http://66.102.9.132/search?q=cache%3A1gF7XulVDLMJ%3Aciteseerx.ist.psu.edu%2Fviewdoc% 2Fdownload%3Fdoi%3D10.1.1.28.4074%26rep%3Drep1%26type%3Dpdf+grouping+of+speech+segments+cluster+distance+concatenation+cost&hl=en >>, Jan. 29, 2010, pp. 8.

"International Search Report", Mailed Date: Oct. 28, 2011, Application No. PCT/US2011/030219, Filed Date: Mar. 28, 2011, pp. 8.

Bellegarda, Jerome R., "Globally optimal training of unit boundaries in unit selection text-to-speech synthesis", Retrieved at <<http://ieeexplore.ieee.org/stamp/stamp.jsp?tp=&arnumber=4100664>>, IEEE Transactions on Audio, Speech and Language Processing, vol. 15, No. 3, Mar. 2007, pp. 957-965.

* cited by examiner

400

446

EXAMPLE CONCATENATION COST MATRIX

452

PRECEDING SEGMENTS

454

450

448

FOLLOWING SEGMENTS

| | please | select | one | for | customer | representative |
|---|---|---|---|---|---|---|
| if | 5 | 4 | 3 | 10 | 4 | 6 |
| your | 10 | 4 | 10 | 6 | 3 | 2 |
| problem | 10 | 9 | 2 | 5 | 2 | 7 |
| is | 10 | 10 | 10 | 10 | 7 | 7 |
| technical | 8 | 7 | 7 | 2 | 4 | 4 |
| please | 10 | 3 | 10 | 10 | 8 | 8 |
| select | 2 | 10 | 3 | 5 | 6 | 6 |
| two | 9 | 3 | 3 | 3 | 6 | 6 |

456

*FIG. 4*

PRE-SAVED DATA COMPRESSION FOR TTS CONCATENATION COST

BACKGROUND

A text-to-speech system (TTS) is one of the human-machine interfaces using speech. TTSs, which can be implemented in software or hardware, convert normal language text into speech. TTSs are implemented in many applications such as car navigation systems, information retrieval over the telephone, voice mail, speech-to-speech translation systems, and comparable ones with a goal of synthesizing speech with natural human voice characteristics. Modern text to speech systems provide users access to multitude of services integrated in interactive voice response systems. Telephone customer service is one of the examples of rapidly proliferating text to speech functionality in interactive voice response systems.

Unit selection synthesis is one approach to speech synthesis, which uses large databases of recorded speech. During database creation, each recorded utterance is segmented into some individual phonemes, diphones, half-phones, syllables, morphemes, words, phrases, and/or sentences. An index of the units in the speech database may then be created based on the segmentation and acoustic parameters like the fundamental frequency (pitch), duration, position in the syllable, and neighboring phonemes. At runtime, the desired target utterance may be created by determining the best chain of candidate units from the database (unit selection).

In unit selection speech synthesis, concatenation cost is used to decide whether two speech segments can be concatenated without noise. However, computation of concatenation cost for complex speech patterns or high quality synthesis may be overly burdensome for real time calculations requiring extensive computation resources. One way to address this challenge is pre-saving concatenation cost data for each pair of possibly concatenated speech segments to avoid real time calculation. Still, this approach introduces large memory requirements possibly in the terabytes.

SUMMARY

This summary is provided to introduce a selection of concepts in a simplified form that are further described below in the Detailed Description. This summary is not intended to exclusively identify key features or essential features of the claimed subject matter, nor is it intended as an aid in determining the scope of the claimed subject matter.

Embodiments are directed to compressing pre-saved concatenation cost data through speech segment grouping. Speech segments may be assigned to a predefined number of groups based on their concatenation cost values with other speech segments. A representative segment may be selected for each group. The concatenation cost between two segments in different groups may then be approximated by that between the representative segments of their respective groups, thereby reducing an amount of concatenation cost data to be pre-saved.

These and other features and advantages will be apparent from a reading of the following detailed description and a review of the associated drawings. It is to be understood that both the foregoing general description and the following detailed description are explanatory and do not restrict aspects as claimed.

BRIEF DESCRIPTION OF THE DRAWINGS

FIG. 4 illustrates an example concatenation cost matrix;

DETAILED DESCRIPTION

As briefly described above, pre-saved concatenation cost data may be compressed through speech segment grouping and use of representative segments for each group. In the following detailed description, references are made to the accompanying drawings that form a part hereof, and in which are shown by way of illustrations specific embodiments or examples. These aspects may be combined, other aspects may be utilized, and structural changes may be made without departing from the spirit or scope of the present disclosure. The following detailed description is therefore not to be taken in a limiting sense, and the scope of the present invention is defined by the appended claims and their equivalents.

While the embodiments will be described in the general context of program modules that execute in conjunction with an application program that runs on an operating system on a personal computer, those skilled in the art will recognize that aspects may also be implemented in combination with other program modules.

Generally, program modules include routines, programs, components, data structures, and other types of structures that perform particular tasks or implement particular abstract data types. Moreover, those skilled in the art will appreciate that embodiments may be practiced with other computer system configurations, including hand-held devices, multiprocessor systems, microprocessor-based or programmable consumer electronics, minicomputers, mainframe computers, and comparable computing devices. Embodiments may also be practiced in distributed computing environments where tasks are performed by remote processing devices that are linked through a communications network. In a distributed computing environment, program modules may be located in both local and remote memory storage devices.

Embodiments may be implemented as a computer-implemented process (method), a computing system, or as an article of manufacture, such as a computer program product or computer readable media. The computer program product may be a computer storage medium readable by a computer system and encoding a computer program that comprises instructions for causing a computer or computing system to perform example process(es). The computer-readable storage medium can for example be implemented via one or more of a volatile computer memory, a non-volatile memory, a hard drive, a flash drive, a floppy disk, or a compact disk, and comparable media.

Throughout this specification, the term "server" generally refers to a computing device executing one or more software programs typically in a networked environment. However, a server may also be implemented as a virtual server (software programs) executed on one or more computing devices viewed as a server on the network. More detail on these technologies and example operations is provided below. The term "client" refers to client devices and/or applications.

Figure 1:
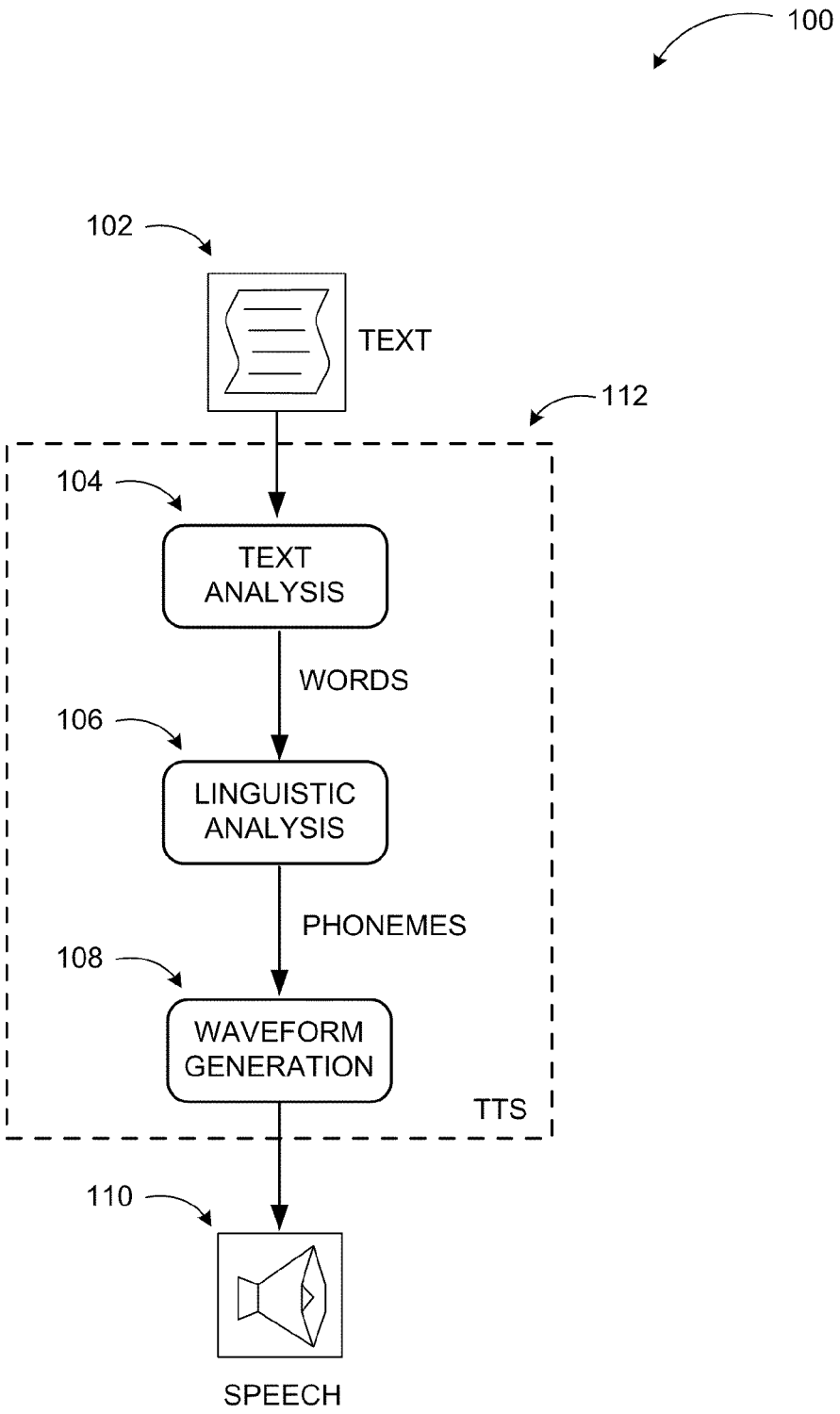
FIG. 1 is a conceptual diagram of a speech synthesis system.

Referring to FIG. 1, block diagram 100 of top level components in a text to speech system is illustrated. Synthesized speech can be created by concatenating pieces of recorded speech from a data store or generated by a synthesizer that incorporates a model of the vocal tract and other human voice characteristics to create a completely synthetic voice output.

Text to speech system (TTS) 112 converts text 102 to speech 110 by performing an analysis on the text to be converted (e.g. by an analysis engine), an optional linguistic analysis, and a synthesis putting together the elements of the final product speech. The text to be converted may be analyzed by text analysis component 104 resulting in individual words, which are analyzed by the linguistic analysis component 106 resulting in phonemes. Waveform generation component 108 (e.g. a speech synthesis engine) synthesizes output speech 110 based on the phonemes.

Depending on a type of TTS, the system may include additional components. The components may perform additional or fewer tasks and some of the tasks may be distributed among the components differently. For example, text normalization, pre-processing, or tokenization may be performed on the text as part of the analysis. Phonetic transcriptions are then assigned to each word, and the text divided and marked into prosodic units, like phrases, clauses, and sentences. This text-to-phoneme or grapheme-to-phoneme conversion is performed by the linguistic analysis component 106.

Major types of generating synthetic speech waveforms include concatenative synthesis, formant synthesis, and Hidden Markov Model (HMM) based synthesis. Concatenative synthesis is based on the concatenation (or stringing together) of segments of recorded speech. While producing close to natural-sounding synthesized speech, in this form of speech generation differences between natural variations in speech and the nature of the automated techniques for segmenting the waveforms may sometimes result in audible glitches in the output. Sub-types of concatenative synthesis include unit selection synthesis, which uses large databases of recorded speech. During database creation, each recorded utterance is segmented into some or all of individual phones, diphones, half-phones, syllables, morphemes, words, phrases, and sentences. An index of the units in the speech database is then created based on the segmentation and acoustic parameters like the fundamental frequency (pitch), duration, position in the syllable, and neighboring phones. At runtime, the desired target utterance is created by determining the best chain of candidate units from the database (unit selection).

Another sub-type of concatenative synthesis is diphone synthesis, which uses a minimal speech database containing all the diphones (sound-to-sound transitions) occurring in a language. A number of diphones depends on the phonotactics of the language. At runtime, the target prosody of a sentence is superimposed on these minimal units by means of digital signal processing techniques such as linear predictive coding. Yet another sub-type of concatenative synthesis is domain-specific synthesis, which concatenates prerecorded words and phrases to create complete utterances. This type is more compatible for applications where the variety of texts to be outputted by the system is limited to a particular domain.

In contrast to concatenative synthesis, formant synthesis does not use human speech samples at runtime. Instead, the synthesized speech output is created using an acoustic model. Parameters such as fundamental frequency, voicing, and noise levels are varied over time to create a waveform of artificial speech. While the speech generated by formant synthesis may not be as natural as one created by concatenative synthesis, formant-synthesized speech can be reliably intelligible, even at very high speeds, avoiding the acoustic glitches that are commonly found in concatenative systems. High-speed synthesized speech is, for example, used by the visually impaired to quickly navigate computers using a screen reader. Formant synthesizers can be implemented as smaller software programs and can, therefore, be used in embedded systems, where memory and microprocessor power are especially limited.

Figure 2:
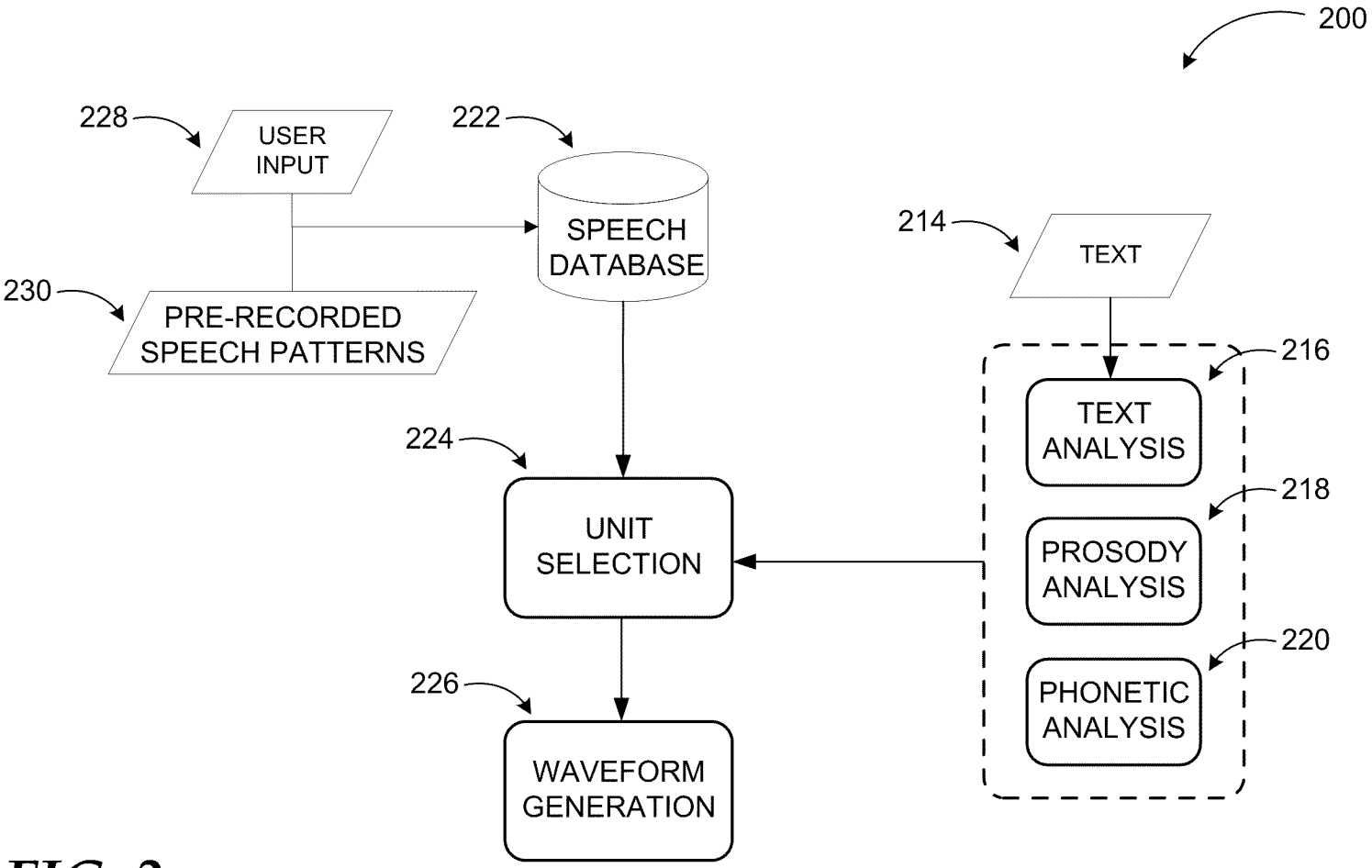
FIG. 2 is a block diagram illustrating major interactions in an example text to speech (TTS) system employing pre-saved concatenation cost data compression according to embodiments.

FIG. 2 is a block diagram illustrating major interactions in an example text to speech (TTS) system employing pre-saved concatenation cost data compression according to embodiments. Concatenative speech systems such as the one shown in diagram 200 include a speech database 222 of stored speech segments. The speech segments may include, depending on the type of system, individual phones, diphones, half-phones, syllables, morphemes, words, phrases, and/or sentences. The speech segments may be provided to the speech database 222 by user input 228 (e.g., recordation and analysis of user speech), pre-recorded speech patterns 230, or other sources. The segmentation of the speech database 222 may also include construction of an inventory of speech segments such that multiple instances of speech segments can be selected at runtime.

The backbone of speech synthesis is segment selection process 224, where speech segments are selected to form the synthesized speech and forwarded to waveform generation process 226 for the generation of the acoustic speech. Segment selection process 224 may be controlled by a plurality of other processes such as text analysis 216 of an input text 214 (to be converted to speech), prosody analysis 218 (pitch, duration, energy analysis), phonetic analysis 220, and/or comparable processes.

Other processes to enhance the quality of the synthesized speech or reduce needed system resources may also be employed. For example, prosody information may be extracted from a Hidden Markov model Text to Speech (HTS) system and used to guide the concatenative TTS system. This may help the system to generate better initial waveforms increasing an efficiency of the overall TTS system.

Figure 3:
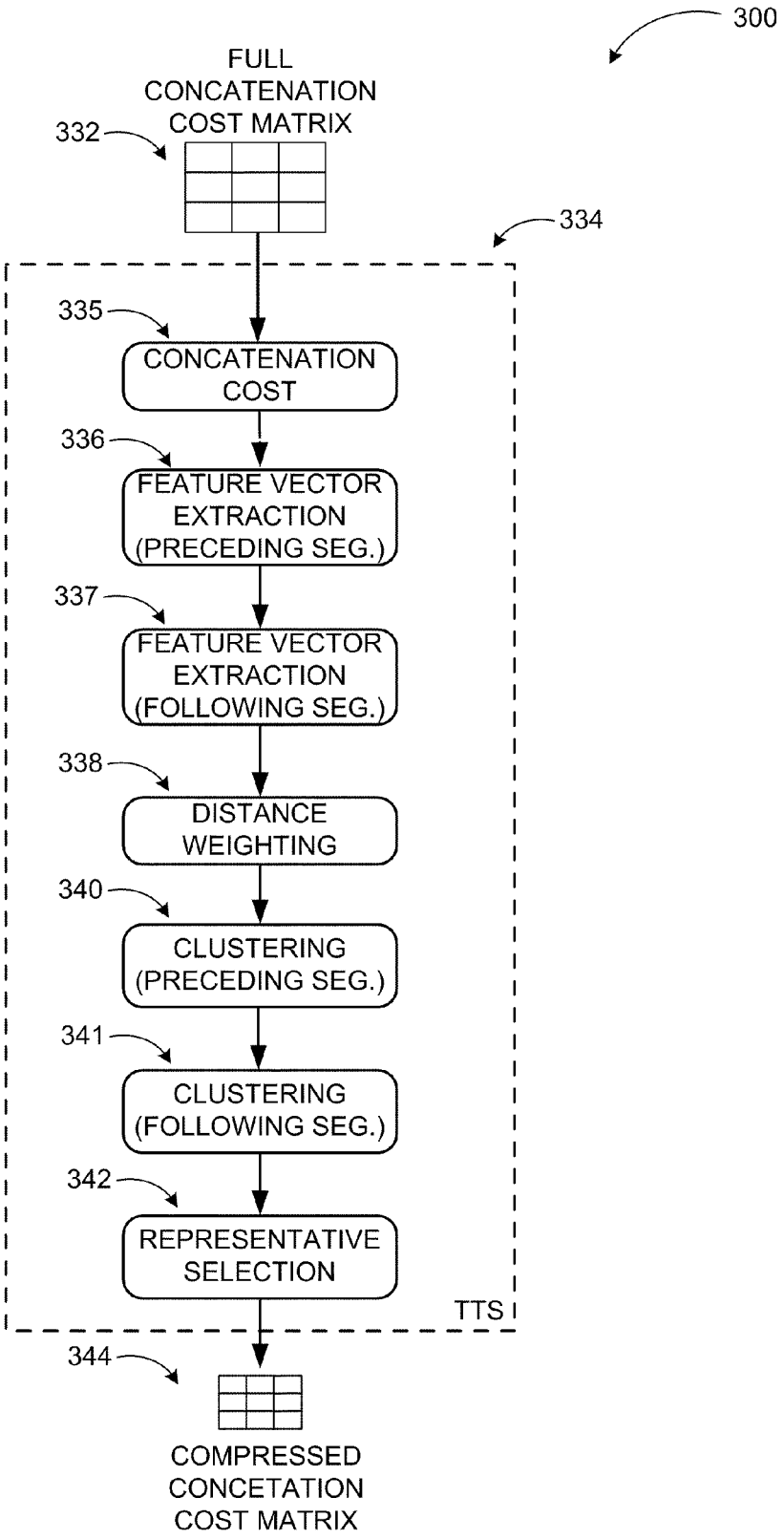
FIG. 3 illustrates blocks of operation for pre-saved concatenation cost data compression in a text to speech system.

FIG. 3 illustrates blocks of operation for pre-saved concatenation cost data compression in a text to speech system in diagram 300. The concatenation cost is an estimate of the cost of concatenating two consecutive segments. This cost is a measure of how well two segments join together in terms of spectral and prosodic characteristics. The concatenation cost for two segments that are adjacent in the segment inventory (speech database) is zero. A speech segment has its feature vector defined as its concatenation cost values with other segments.

Thus, in a text to speech system (334) according to embodiments, concatenation cost 335 is determined from (or stored in) a full concatenation matrix 332, which lists the costs between each stored segment. The distance between two speech segments is that of their feature vectors under a particular distance function (e.g., Euclidean distance, city block, etc.). Thus, feature vectors for preceding and following speech segments may be extracted (336 and 337) before distance based weighting. In a system according to embodiments, distance weighting 338 may be added, as larger concatenation cost is less sensitive to compression errors. In other embodiments, largest cost path may also be used as determining factor. This is because concatenation pairs with large concatenation cost are less likely to be used in segment selection. An example distance function may be:

$$\text{distance}(seg_i, seg_j) = \sum_{m=1}^{n} \{\text{abs}(cc_{i,m} - cc_{j,m}) * [K_0 - (cc_{i,m} + cc_{j,m})]\}^2, \quad [1]$$

where $seg_i$ and $seg_j$ are two segments with $seg_i$ preceding $seg_j$. $cc_{xy}$ represent concatenation costs between respective segments, and $K_0$ is a predefined constant. The feature vector for speech segment i is ($cc_{i,1}$ $cc_{i,2}$, . . . , $cc_{i,n}$) when it is the preceding segment, or ($cc_{1,i}$ $cc_{2,i}$, . . . , $cc_{n,i}$) when it is the following segment. The value of the concatenation cost is different when the order of the two segments is switched, i.e. j precedes i.

After distance weighting, a clustering processes 340 and 341 for preceding and following speech segments may be performed to divide all segments into M preceding and N following groups, which minimizes the average distance between segments within the same group. For example, segment data based on 14 hours of recorded speech may generate a full concatenation matrix of approximately 1 TB. The speech segments in this example may be clustered into 1000 groups resulting in a compressed concatenation matrix of 10 MB (composed of 4 MB cost table (1000*1000*size of float), and 6 MB indexing data). Clustering and distance weighting may be performed with any suitable function using the principles described herein. The above listed weighting function is for illustration purposes only.

Clustering processes 340 and 341 may be followed by selection of a representative for each group (342). The representative segment for each group may be selected such that it has the smallest average distance to other segments within the same group. The M×N concatenation cost matrix for representative segments (344) may then be constructed and pre-saved. The pre-saved concatenation cost data size is reduced to [$n^2$/(M×N)] of the original matrix 332, where n is the total number of speech segments. The concatenation cost between two speech segments may now be approximated by that between the representative segments of their respective (preceding or following) groups.

FIG. 4 illustrates an example concatenation cost matrix. As mentioned above, the speech segment inventory may include individual phones, diphones, half-phones, syllables, morphemes, words, phrases, and/or sentences. The example concatenation cost matrix 446 shown in diagram 400 is for words that may be combined to create voice prompts.

The segments 450 and 454 are categorized as preceding and following segments 452, 448. For each of the segments a concatenation cost (e.g. 456) is computed and stored in the matrix. This illustrative example is for a limited database of a few words only. As discussed previously, a typical TTS system may require segments generated from speech recordings of 14 hours or more, which results in concatenation cost data ranging in terabytes. Such a large matrix is difficult to pre-save or compute in real time. One approach to address the size of the data is to save concatenation costs only for select pairs of speech segments. Another is reducing precision, for example storing data in four bits chunks. With both approaches, however, the data to be pre-saved for reasonable speech synthesis is still relatively large (e.g. in the hundreds of megabytes) and missing values may be encountered resulting in degradation of quality.

Figure 5:
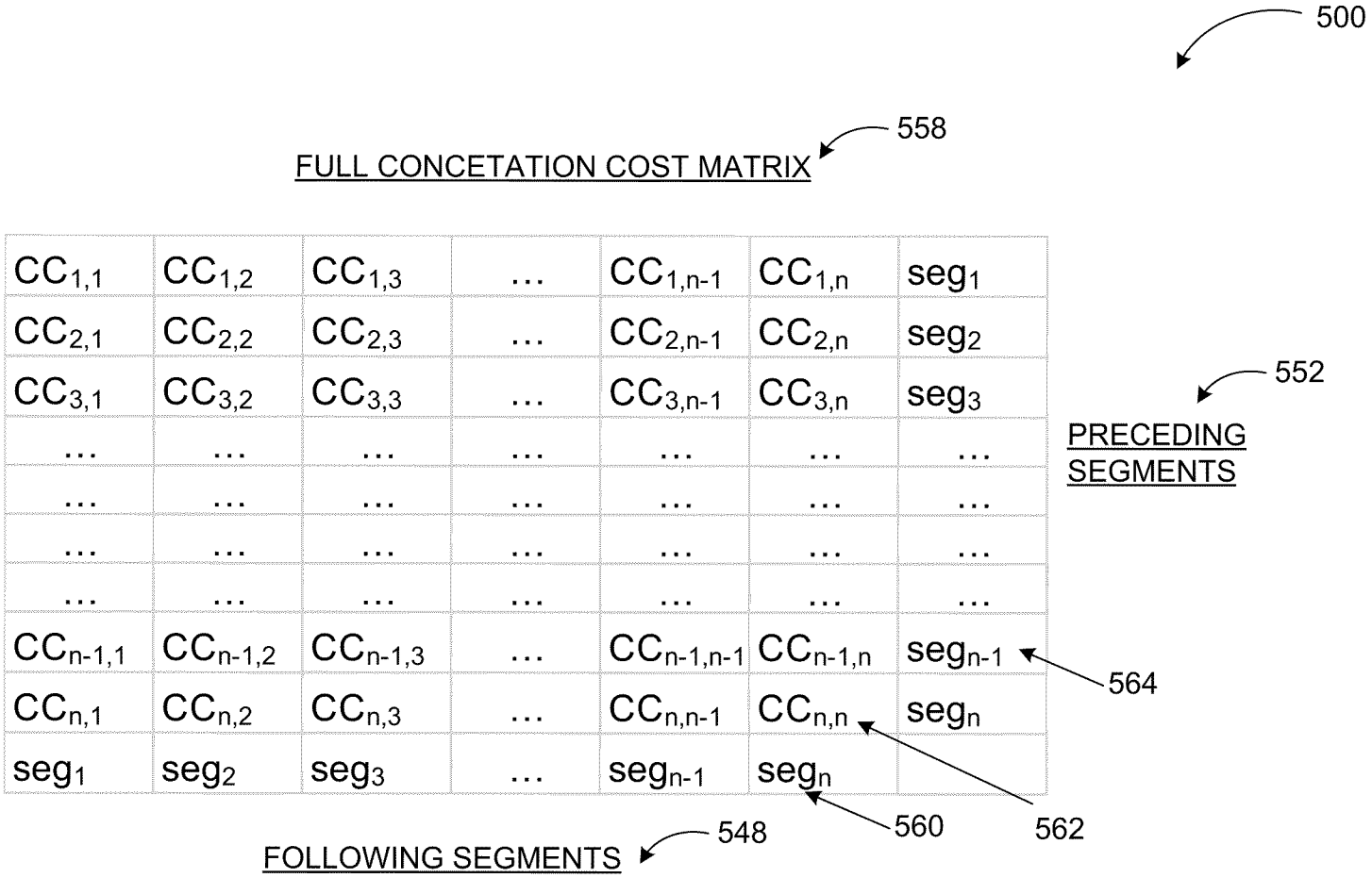
FIG. 5 illustrates a generalized concatenation cost matrix.

FIG. 5 illustrates diagram 500 including a generalized concatenation cost matrix 558. The concatenation cost (e.g. 562) is defined as $cc_{i,j}$ for concatenation between speech segment i and j (segment j following segment i). It should be noted that the value is different when the order of the two segments is switched (i.e. j precedes i). Thus, a speech segment's feature vector may be defined as its concatenation cost values with other segments. For example, the feature vector for speech segment i is ($cc_{i,1}$ $cc_{i,2}$, . . . , $cc_{i,n}$) when it is the preceding segment (552) or ($cc_{1,i}$ $cc_{2,i}$, . . . , $cc_{n,i}$) when it is the following segment (548). The feature vector may also use a portion of the concatenation cost values with other segments to reduce computation cost.

The full matrix 558 consists all n×n concatenation cost values between n speech segments (e.g. 560, 564). Each row along preceding speech segment axis corresponds to a preceding segment 552. Each column along a following speech segment axis corresponds to a following segment 548. The distance between two preceding segments $seg_i$ and $seg_j$ is a function (e.g. Euclidean distance or city block distance) of ($cc_{i,1}$, $cc_{i,2}$, . . . , $cc_{i,n}$, $cc_{j,1}$, $cc_{j,2}$, . . . , $cc_{j,n}$). Similar distances may be defined for pairs of following segments 548.

Figure 6:
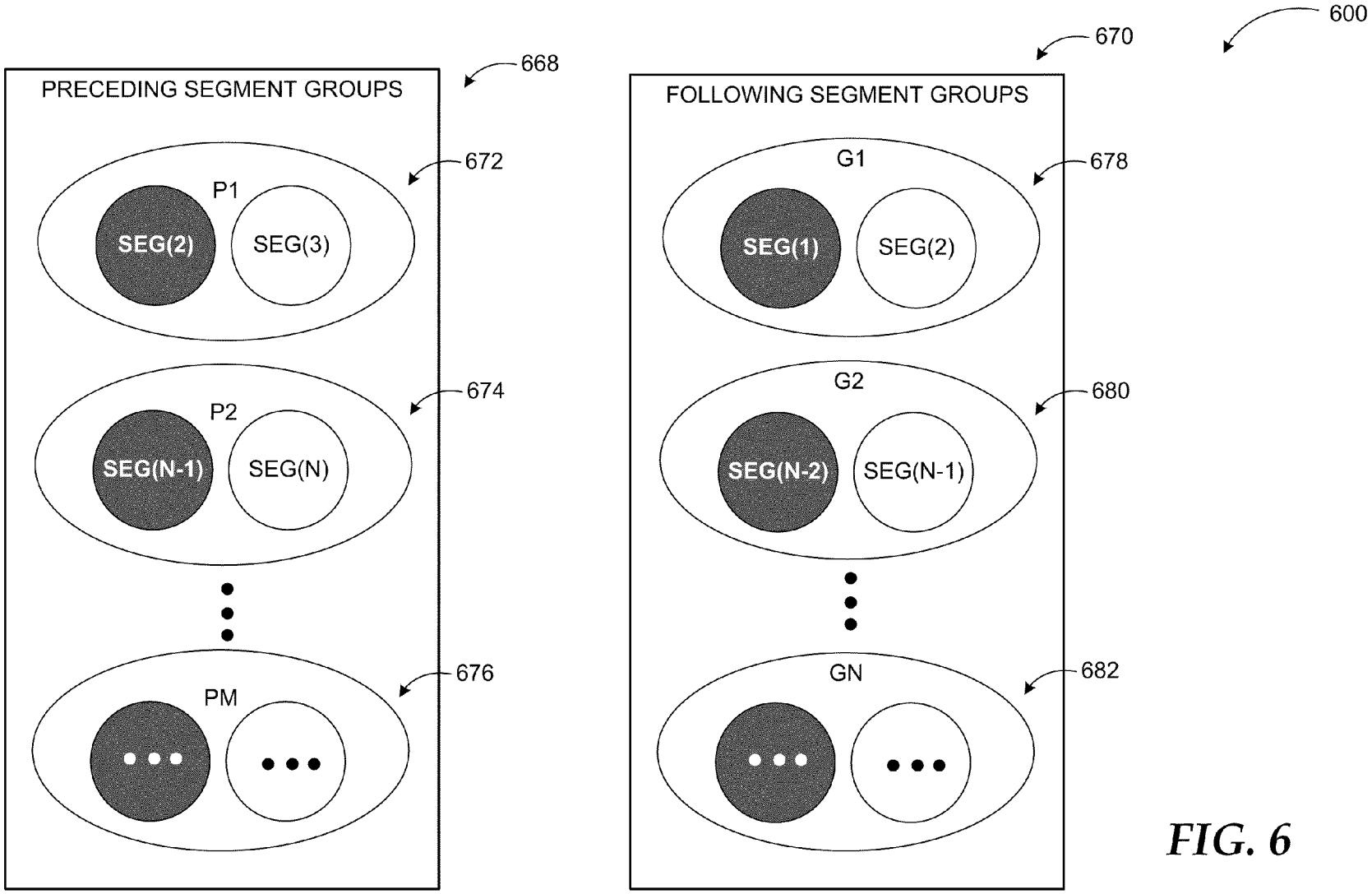
FIG. 6 illustrates grouping of speech segments and representative segments for each group in preceding segment and following segment categories according to embodiments.

FIG. 6 illustrates diagram 600 of grouping of speech segments and representative segments for each group in preceding segment (668) and following segment (670) categories according to embodiments.

In a TTS system according to embodiments, the speech segments may be placed into M preceding (672, 674, 676) and N following groups (678, 680, 682), to minimize the within group average distance between each segments. The dark segments in each group are example representative segments of their respective groups.

While the example groups are shown with two segments each, the number of segments in each group may be any predefined number. The number of groups and segments within each group may be determined based on a total number of segments, distances between segments, desired reduction in concatenation cost data, and similar considerations.

Figure 7:
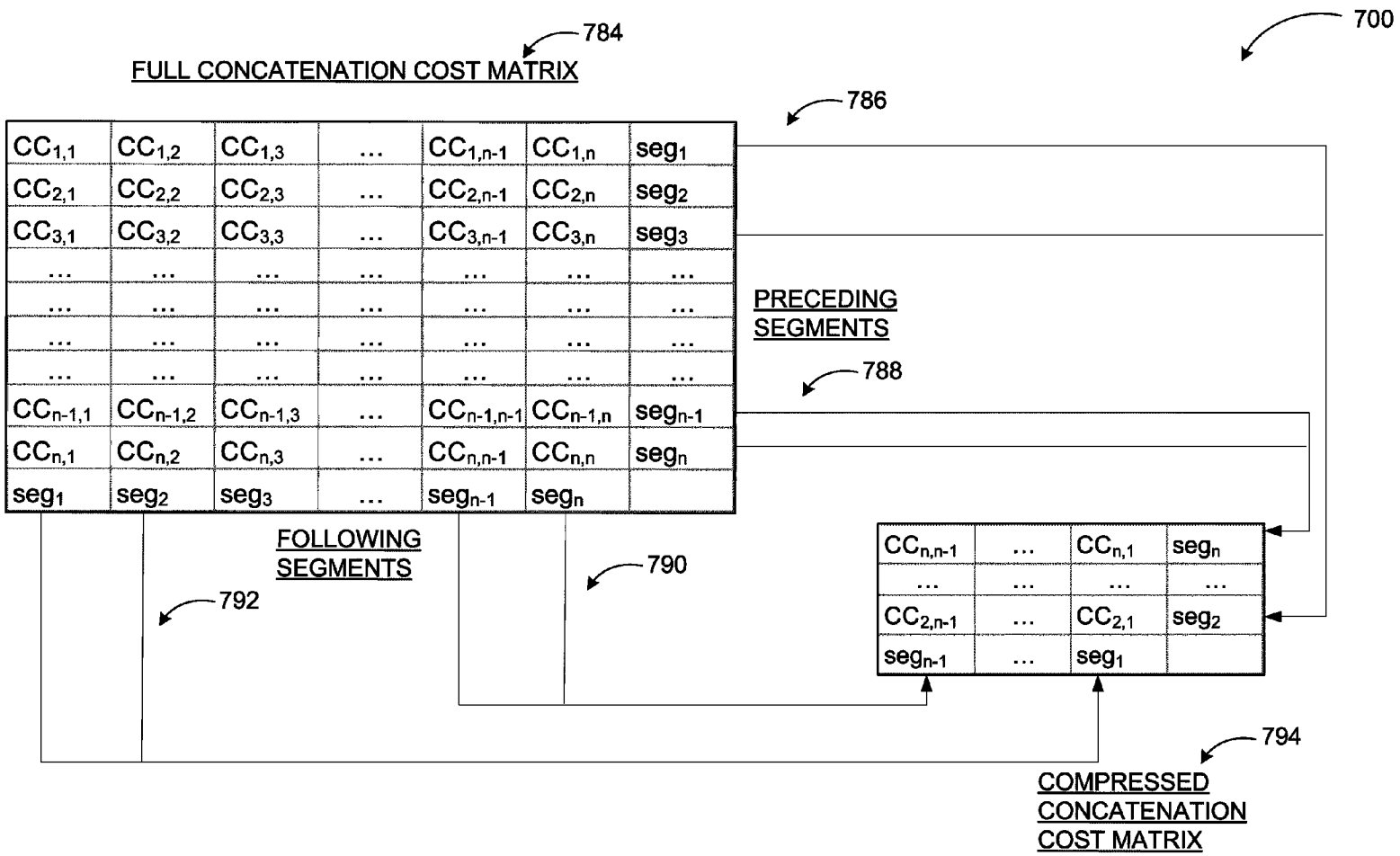
FIG. 7 illustrates compression of a full concatenation cost matrix to a representative segment concatenation cost matrix.

FIG. 7 illustrates compression of a full concatenation cost matrix 784 to a representative segment concatenation cost matrix 794 in diagram 700. Employing a clustering and representative selection process as discussed previously, representative segments for each of the groupings within full concatenation cost matrix 784 may be determined and the full matrix compressed to contain only concatenation costs between representative segments (e.g. 786, 788, 790, and 792). For example, the values of $cc_{2,1}$ $cc_{2,2}$ $cc_{3,1}$ $cc_{3,2}$ are all approximated by $cc_{2,1}$ in the example compressed matrix 794.

According to other embodiments, an alternative approach to representative segment selection is center re-estimation. As mentioned above, the values of $cc_{2,1}$ $cc_{2,2}$ $cc_{3,1}$ $cc_{3,2}$ are all approximated by $cc_{2,1}$, with segment 2 and segment 1 being the representative segments of preceding/following groups in diagram 700. Instead of using $cc_{2,1}$ as center, another approximation may be the mean or median of $cc_{2,1}$ $cc_{2,2}$ $cc_{3,1}$ $cc_{3,2}$. Thus, only grouping result may be employed without selecting a representative segment from each group. Furthermore, the center value may be estimated with a portion of whole samples to overcome the computation cost when segment numbers are large.

While the example systems and processes have been described with specific components and aspects such as particular distance functions, clustering techniques, or representative selection methods, embodiments are not limited to the example components and configurations. A TTS system compressing concatenation cost data for pre-saving may be implemented in other systems and configurations using other aspects of speech synthesis using the principles described herein.

Figure 8:
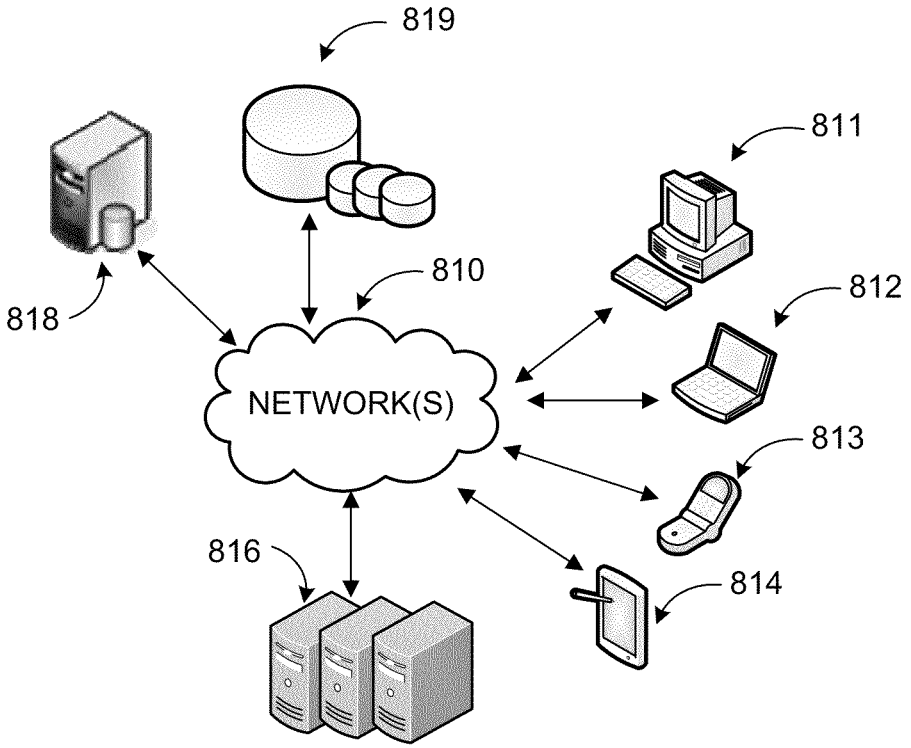
FIG. 8 is a networked environment, where a system according to embodiments may be implemented.

FIG. 8 is an example networked environment, where embodiments may be implemented. A text to speech system providing speech synthesis services with concatenation cost data compression may be implemented via software executed in individual client devices 811, 812, 813, and 814 or over one or more servers 816 such as a hosted service. The system may facilitate communications between client applications on individual computing devices (client devices 811-814) for a user through network(s) 810.

Client devices 811-814 may provide synthesized speech to one or more users. Speech synthesis may be performed through real time calculations using a pre-saved, compressed concatenation cost matrix that is generated by clustering speech segments based on their distances and selecting representative segments for each group. Information associated with speech synthesis such as the compressed concatenation cost matrix may be stored in one or more data stores (e.g. data stores 819), which may be managed by any one of the servers 816 or by database server 818.

Network(s) 810 may comprise any topology of servers, clients, Internet service providers, and communication media. A system according to embodiments may have a static or dynamic topology. Network(s) 810 may include a secure network such as an enterprise network, an unsecure network such as a wireless open network, or the Internet. Network(s) 810 may also coordinate communication over other networks such as PSTN or cellular networks. Network(s) 810 provides communication between the nodes described herein. By way of example, and not limitation, network(s) 810 may include wireless media such as acoustic, RF, infrared and other wireless media.

Many other configurations of computing devices, applications, data sources, and data distribution systems may be employed to implement a TTS system employing concatenation data compression for pre-saving. Furthermore, the networked environments discussed in FIG. 8 are for illustration purposes only. Embodiments are not limited to the example applications, modules, or processes.

Figure 9:
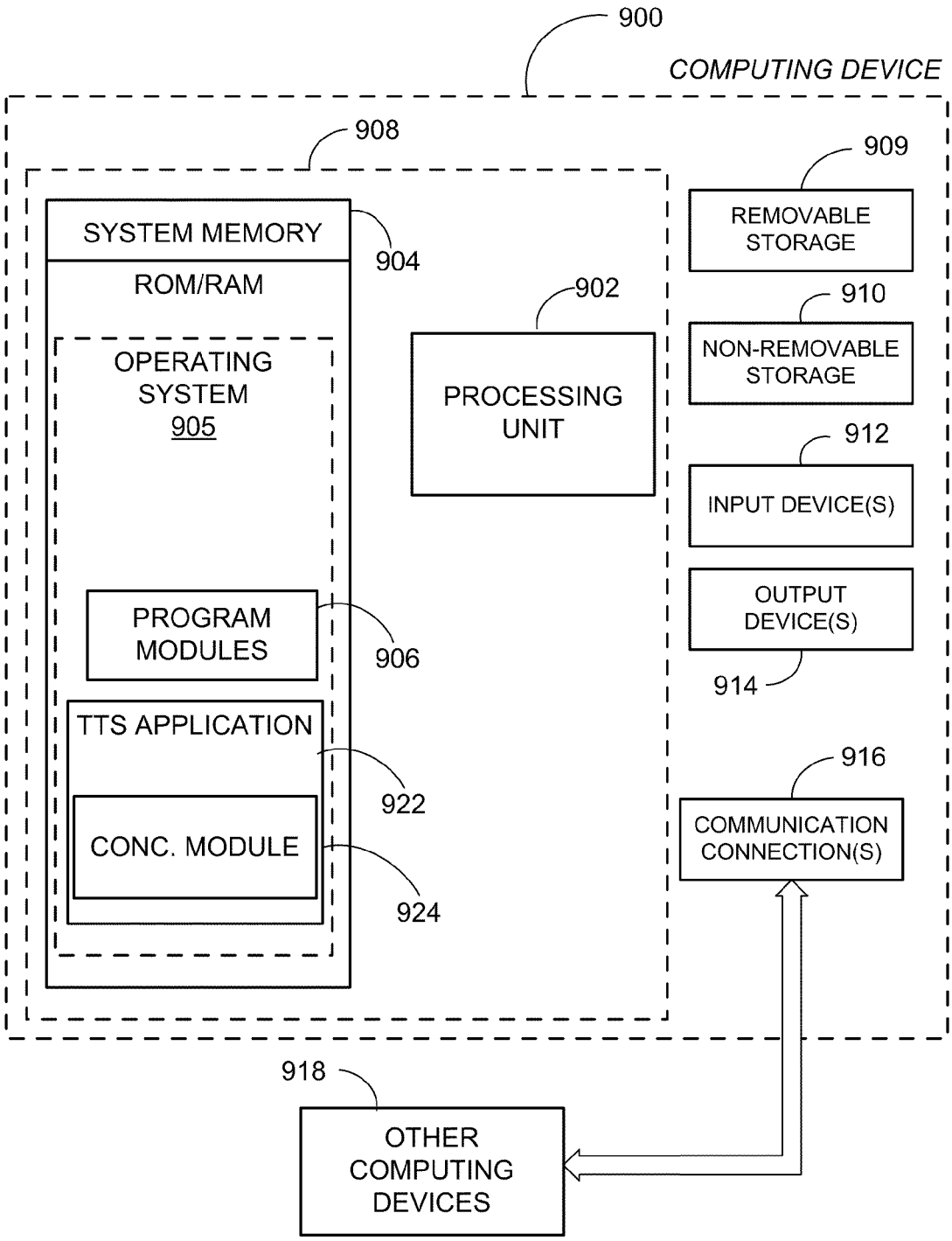
FIG. 9 is a block diagram of an example computing operating environment, where embodiments may be implemented.

FIG. 9 and the associated discussion are intended to provide a brief, general description of a suitable computing environment in which embodiments may be implemented. With reference to FIG. 9, a block diagram of an example computing operating environment for an application according to embodiments is illustrated, such as computing device 900. In a basic configuration, computing device 900 may be a client device or server executing a TTS service and include at least one processing unit 902 and system memory 904. Computing device 900 may also include a plurality of processing units that cooperate in executing programs. Depending on the exact configuration and type of computing device, the system memory 904 may be volatile (such as RAM), non-volatile (such as ROM, flash memory, etc.) or some combination of the two. System memory 904 typically includes an operating system 905 suitable for controlling the operation of the platform, such as the WINDOWS® operating systems from MICROSOFT CORPORATION of Redmond, Wash. The system memory 904 may also include one or more software applications such as program modules 906, TTS application 922, and concatenation module 924.

Speech synthesis application 922 may be part of a service or the operating system 905 of the computing device 900. Speech synthesis application 922 generates synthesized speech employing concatenation of speech segments. As discussed previously, concatenation cost data may be compressed by clustering speech segments based on their distances and selecting representative segments for each group. Concatenation module 924 or speech synthesis application 922 may perform the compression operations. This basic configuration is illustrated in FIG. 9 by those components within dashed line 908.

Computing device 900 may have additional features or functionality. For example, the computing device 900 may also include additional data storage devices (removable and/or non-removable) such as, for example, magnetic disks, optical disks, or tape. Such additional storage is illustrated in FIG. 9 by removable storage 909 and non-removable storage 910. Computer readable storage media may include volatile and nonvolatile, removable and non-removable media implemented in any method or technology for storage of information, such as computer readable instructions, data structures, program modules, or other data. System memory 904, removable storage 909 and non-removable storage 910 are all examples of computer readable storage media. Computer readable storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 900. Any such computer readable storage media may be part of computing device 900. Computing device 900 may also have input device(s) 912 such as keyboard, mouse, pen, voice input device, touch input device, and comparable input devices. Output device(s) 914 such as a display, speakers, printer, and other types of output devices may also be included. These devices are well known in the art and need not be discussed at length here.

Computing device 900 may also contain communication connections 916 that allow the device to communicate with other devices 918, such as over a wireless network in a distributed computing environment, a satellite link, a cellular link, and comparable mechanisms. Other devices 918 may include computer device(s) that execute communication applications, other servers, and comparable devices. Communication connection(s) 916 is one example of communication media. Communication media can include therein computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media.

Example embodiments also include methods. These methods can be implemented in any number of ways, including the structures described in this document. One such way is by machine operations, of devices of the type described in this document.

Another optional way is for one or more of the individual operations of the methods to be performed in conjunction with one or more human operators performing some. These human operators need not be collocated with each other, but each can be only with a machine that performs a portion of the program.

Figure 10:
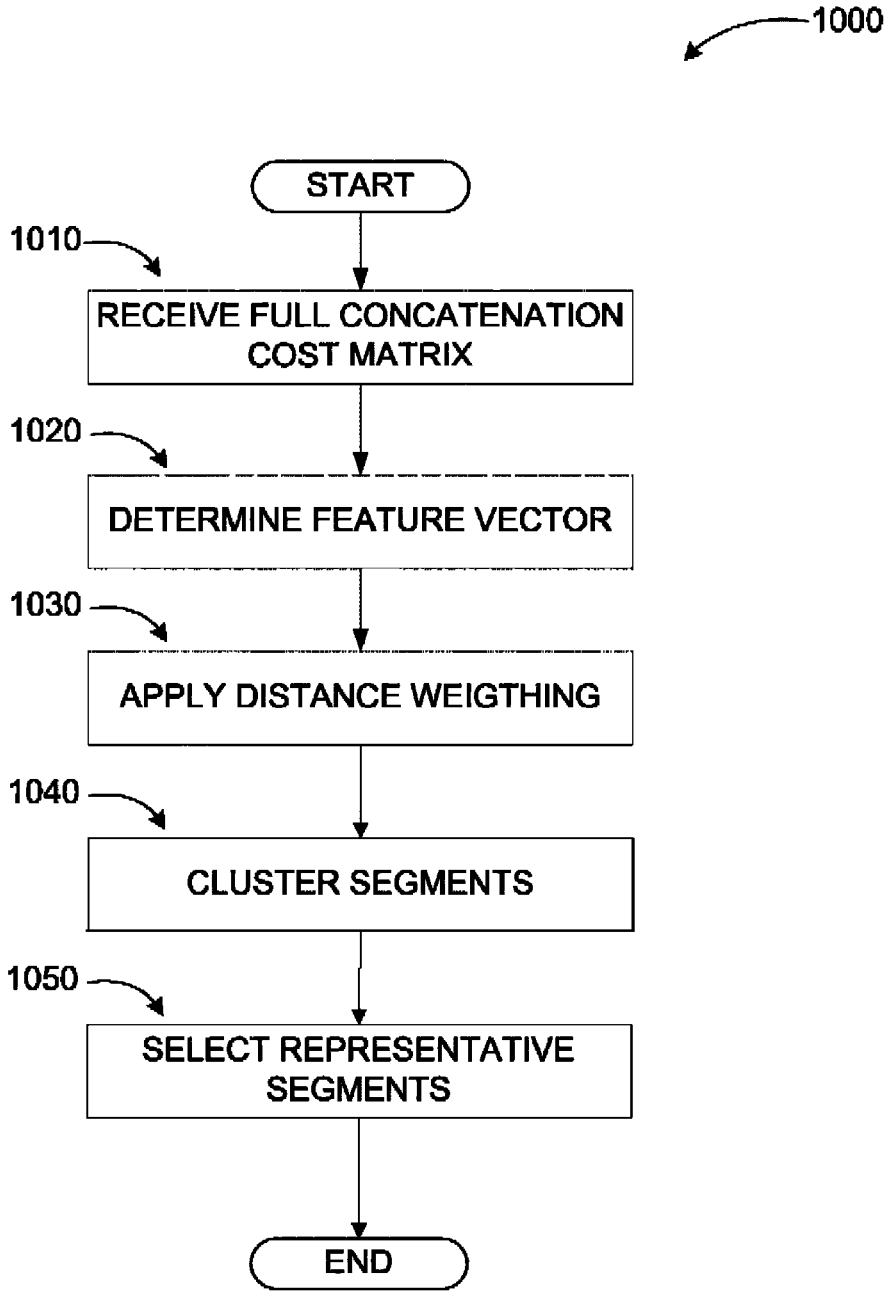
FIG. 10 illustrates a logic flow diagram for compressing pre-saved concatenation cost data through speech segment grouping according to embodiments.

FIG. 10 illustrates a logic flow diagram for process 1000 of compressing pre-saved concatenation cost data through speech segment grouping according to embodiments. Process 1000 may be implemented as part of a speech generation program in any computing device.

Process 1000 begins with operation 1010, where a full concatenation matrix is received at the TTS application. The matrix may be computed by the application based on received segment data or provided by another application responsible for the speech segment inventory. At operation 1020, feature vectors for the segments are determined as discussed previously. This is followed by operation 1030, where distance weighting is applied using a distance function such as the one described in conjunction with FIG. 3. At operation 1040, the segments are clustered such that an average distance between segments within each group is minimized. Operation 1040 is followed by operation 1050, where a representative segment for each group is selected such that the representative segment has the smallest average distance to other segments within the same group. Alternative methods of selecting representative segments such as median or mean computation may also be employed. The representative segments form the compressed concatenation cost matrix, which may reduce the size of the data to $[n^2/(M\times N)]$ of the original matrix (of $M\times N$ elements).

The operations included in process 1000 are for illustration purposes. A TTS system employing pre-saved data compression for concatenation cost may be implemented by similar processes with fewer or additional steps, as well as in different order of operations using the principles described herein.

The above specification, examples and data provide a complete description of the manufacture and use of the composition of the embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and embodiments.

What is claimed is:

1. A computing device for performing concatenative speech synthesis by a processing unit of the computing device, the computing device comprising:

a memory;

a processor coupled to the memory, the processor executing a text to speech (TTS) application in conjunction with instructions stored in the memory, wherein the TTS application is configured to:

determine, based on a matrix of concatenation costs, feature vectors for speech segments, wherein some of the speech segments occur at asynchronous time intervals;

apply distance weighting to one of: the speech segments and at least two consecutive speech segments, wherein the distance weighting is based on feature vectors associated with the speech segments or is based on feature vectors associated with the at least two consecutive speech segments;

cluster the speech segments into a predefined number of groups such that an average distance between speech segments within each group is minimized;

select a representative speech segment for each group; and generate a compressed concatenation cost matrix based on the representative speech segments.

2. The computing device of claim 1, wherein the TTS application is further configured to:

pre-save the compressed concatenation cost matrix for real time computations in synthesizing speech.

3. The computing device of claim 1, wherein the distance weighting is applied employing one of: a Euclidean distance function and a city block distance function.

4. The computing device of claim 1, wherein the compressed concatenation cost matrix is constructed along a preceding speech segment and a following speech segment, wherein the preceding speech segment and the following speech segment are the at least two consecutive speech segments.

5. The computing device of claim 4, wherein a concatenation cost between the at least two consecutive speech segments is different from another concatenation cost between at least two similar consecutive speech segments with an order of the speech segments reversed.

6. The computing device of claim 1, wherein the representative speech segment for each group is selected such that an average distance between the representative speech segment and other speech segments within a similar group is minimized.

7. The computing device of claim 1, wherein a number of the groups is determined based on at least one from a set of: a total number of speech segments, distances between the speech segments, and a desired reduction in concatenation cost data.

8. The computing device of claim 1, wherein the representative speech segment for each group is selected based on one of a median concatenation cost and a mean concatenation cost of each group.

9. The computing device of claim 1, wherein the speech segments include one of: individual phones, diphones, half-phones, and syllables.

10. A computing device for generating speech employing compressed concatenation cost data, the computing device comprising:

a memory;

a processor coupled to the memory, the processor executing a text to speech (TTS) application in conjunction with instructions stored in the memory, wherein the TTS application is configured to:

determine feature vectors for speech segments, wherein the feature vectors comprise concatenation cost values, and wherein the concatenation cost values are costs of concatenating the speech segments with at least two consecutive speech segments;

apply distance weighting to one of: the speech segments and the at least two consecutive speech segments, wherein the distance weighting is based on feature vectors associated with the speech segments or is based on feature vectors associated with the at least two consecutive speech segments cluster the speech segments into a predefined number of groups such that an average distance between speech segments within each group is minimized;

select a representative speech segment for each group such that an average distance between the representative speech segment and other speech segments within a similar group are minimized;

generate a compressed concatenation cost matrix based on the representative speech segments; and pre-save the compressed concatenation cost matrix for real time computations in synthesizing speech.

11. The computing device of claim 10, wherein the distance weighting is applied such that a sensitivity to compression errors is reduced.

12. The computing device of claim 10, wherein the representative speech segment for each group is further selected based on center re-estimation.

13. The computing device of claim 10, wherein a speech segment data store is configured to receive the speech segments from at least one of: a user input and a set of prerecorded speech patterns.

14. The computing device of claim 10, wherein an analysis engine is configured to:

perform at least one from a set of: text analysis, prosody analysis, and phonetic analysis; and provide input to a speech synthesis engine for segment selection based on a plurality of performed analyses.

15. A computer-readable memory device with instructions stored thereon for generating speech employing compressed concatenation cost data, the instructions comprising:

determining, based on a matrix of concatenation costs, feature vectors for speech segments, wherein the matrix of concatenation costs is constructed along a preceding speech segment and a following speech segment for each segment applying distance weighting to one of: the speech segments and at least two consecutive speech segments, wherein the distance weighting is based on feature vectors associated with the speech segments or is based on feature vectors associated with the at least two consecutive speech segments clustering the speech segments into M preceding segment and N following segment groups such that an average distance between speech segments within each group is minimized;

selecting a representative speech segment for each group;

generating a compressed concatenation cost matrix such that a concatenation cost between the speech segments and the at least two consecutive speech segments is approximated by a concatenation cost between a representative segment associated with the speech segments and another representative speech segment associated with the at least two consecutive speech segments; and pre-saving the compressed concatenation cost matrix for real time computations in synthesizing speech.

16. The computer-readable memory device of claim 15, wherein the distance weighting is applied employing distance function:

$$\sum_{m=1}^{n} \{\mathrm{abs}(cc_{i,m} - cc_{j,m}) * [K_o - (cc_{i,m} + cc_{j,m})]\}^2,$$

where $cc_{i,j}$ are concatenation costs between speech segments i and j, $K_o$ is a predefined constant, and n is a total number of the speech segments.

17. The computer-readable memory device of claim 15, wherein the instructions further comprise:

determining M and N based on at least one from a set of: a total number of speech segments, distances between the speech segments, and a desired reduction in concatenation cost data.

18. The computer-readable memory device of claim 15, wherein a size of pre-saved concatenation data is reduced by $[n^2/(M \times N)]$, where n is a total number of the speech segments.

* * * * *